US012497970B2

(12) United States Patent
Ediger et al.

(10) Patent No.: US 12,497,970 B2
(45) **Date of Patent: *Dec. 16, 2025**

(54) TOWER CROSSFLOW FAN WITH ORIENTABLE SUPPORTS

(71) Applicant: Vornado Air, LLC, Andover, KS (US)

(72) Inventors: Glen Wesley Ediger, North Newton, KS (US); Byron Loibl, Wichita, KS (US); Gregory Pease, Andover, KS (US); Brian M. Cartwright, Wichita, KS (US); Cooper Phillips, Wichita, KS (US)

(73) Assignee: Vornado Air, LLC, Andover, KS (US)

( * ) Notice: Subject to any disclaimer, the term of this patent is extended or adjusted under 35 U.S.C. 154(b) by 0 days.

This patent is subject to a terminal disclaimer.

(21) Appl. No.: 18/737,651

(22) Filed: Jun. 7, 2024

(65) Prior Publication Data

US 2025/0012284 A1 Jan. 9, 2025

Related U.S. Application Data

(63) Continuation of application No. 17/829,122, filed on May 31, 2022, now Pat. No. 12,006,940.
(Continued)

(51) Int. Cl.

| | |
|---|---|
| ***F04D 17/04*** | (2006.01) |
| ***F04D 29/52*** | (2006.01) |
| ***F04D 29/60*** | (2006.01) |

(52) U.S. Cl.
CPC ..... *F04D 17/04* (2013.01); *F04D 29/522* (2013.01); *F04D 29/601* (2013.01)

(58) Field of Classification Search
CPC ..... F04D 17/04; F04D 29/522; F04D 29/601; F04D 25/08; F04D 25/166
See application file for complete search history.

(56) References Cited

U.S. PATENT DOCUMENTS 5,503,526 A 4/1996 Neils et al.
12,006,940 B2 * 6/2024 Ediger ..... F04D 29/522
(Continued)

FOREIGN PATENT DOCUMENTS

CN 1626830 A * 6/2005 ..... F04D 17/04
CN 212250531 U 12/2020

OTHER PUBLICATIONS

Machine Translation of CN 1626830 A PDF File Name: "CN 1626830A_Machine_Translation.pdf" (Year: 2005).*

*Primary Examiner* — Hung Q Nguyen
*Assistant Examiner* — Ruben Picon-Feliciano
(74) *Attorney, Agent, or Firm* — Avyno Law P.C.

(57) ABSTRACT

A tower fan is provided that includes a fan body having a double cross fan blower centered in the body of the fan with a motor positioned between the fan blowers. The tower fan is capable of being oriented in both the horizontal and vertical directions. The fan body may further include first and second ends and at least two supports. At least a first support is coupled to the first end of the fan body and a second support is removably coupled to the least second end of the fan body. The first and second ends of the fan body each have a groove for each receiving at least one of the two support members where each groove extends around the fan body. The supports may be removably coupled to the fan body or one of the at least two supports may be permanently coupled to the fan body.

10 Claims, 10 Drawing Sheets

Related U.S. Application Data

(60) Provisional application No. 63/195,156, filed on May 31, 2021.

(56) References Cited

U.S. PATENT DOCUMENTS

| | | | | |
|---|---|---|---|---|
| 2006/0008353 | A1* | 1/2006 | Wang | F04D 25/105<br>416/244 R |
| 2006/0093463 | A1* | 5/2006 | Iyer | F04D 17/04<br>415/53.1 |
| 2014/0112791 | A1 | 4/2014 | Abell | |

* cited by examiner

TOWER CROSSFLOW FAN WITH ORIENTABLE SUPPORTS

CROSS REFERENCE TO RELATED APPLICATIONS

This application is a continuation of U.S. Non-Provisional patent application Ser. No. 17/829,122, filed on May 31, 2022, titled Tower Crossflow Fan With Orientable Supports, which application claims priority to U.S. Provisional Patent Application No. 63/195,156, filed on May 31, 2021, titled Tower Crossflow Fan With Orientable Supports, which applications are incorporated into this application in their entirety by reference.

FIELD OF INVENTION

The invention relates to a fan and, in particular, to a tower fan having double crossflow blowers that allow for the fan to be easily oriented in both the horizontal and vertical directions. The invention further includes modular base options for the tower fan in the form of reconfigurable and orientable supports.

BACKGROUND

Tower fans are generally constructed with the crossflow blower mounted in a vertical orientation, with air coming in on one side and exiting out the front. Variations may include, for example, oscillation and variable speeds, to name a few. Typical construction is to have the motor that drives the crossflow blower mounted near the bottom of the unit with the crossflow blower concentrically mounted above the motor. These fans typically have no other orientation other than vertical. Since vertical tower fans use long blowers, the fans are often difficult to balance and may cause unwanted vibration and noise. Vertical fans are not designed to be oriented both vertically and horizontally.

A need exists for a vertical tower fan that is stable, does not cause unwanted vibrations and noise and that can be positioned either vertically or horizontally—as a tower fan or a horizontal fan bar.

SUMMARY

The present invention offers a tower fan that is configurable in the both the vertical and horizontal positions. The tower fan of the present invention uses a double shafted motor to turn a crossflow blower above and below the motor, where the motor is mounted in the center of the fan. As such, the design uses two shorter blowers, rather than one long blower. With the motor centrally mounted, the shorter blowers are less likely to be out of balance. Having the motor in the middle also minimizes electrical wiring complexity and centralizes the center of gravity for the motor so that the fan is able to be easily oriented in either the vertical or horizontal position, which is a feature not currently found in other portable crossflow blower tower fans. When in the vertical orientation, the fan can operate like a tower fan. When in the horizontal orientation, the fan can operate like a fan bar.

The fan body has a double crossflow blower mounted in the body of the fan, where the double crossflow blower includes a first and second blower having a motor mounted between the first and a second blowers. The motor is centered within the body of the fan. In certain examples, the fan further includes at least two supports, where at least a first support is coupled to the first end of the fan body and where at least a second support member is removably coupled to the least second end of the fan body. The double crossflow blower including a motor centered within the body of the fan.

In another example, the fan is capable of being oriented in both the horizontal and vertical directions, the fan includes a fan body having a first and second end and at least two leg support members. At least a first leg support member is coupled to the first end of the fan body and at least a second leg support member is removably coupled to the least second end of the fan body. The first and second ends of the fan body each have a groove for receiving at least one of the at least two leg supports members, where the at least one leg support member may be either removably or permanently coupled to the first end of the fan body. In another example, the at least two leg support members are designed to simultaneously couple to the groove in the first end of the fan body to support the fan in a vertical position, and where each leg support member has at least one support contact for supporting the fan on a support surface. The fan body of this example may house a double cross fan blower centered in the body of the fan.

In certain examples, each groove in the first and second ends of the fan body may also include at least two half rings that each fit within and couple to the grooves in the first and second ends of the fan body and that when positioned within in the grooves with a first or second leg support member the half rings mate with the leg support member. Each groove may extend entirely around the fan body and each include at least one half ring or finishing ring member that each fit within and couple to the grooves in the first and second ends of the fan body. When the half rings are positioned within the grooves within a first or second leg support member with at least one leg support member, each half ring may mate with the leg support member.

In another example a fan is provided that is capable of being oriented in both the horizontal and vertical directions, where the fan includes a fan body having a first and second end and at least two supports. At least a first support is coupled to the first end of the fan body and a second support is removably coupled to the least second end of the fan body. The first and second ends of the fan body each have a groove for each receiving at least one of the at least two supports where each groove extends entirely around the fan body. The at least two supports may each include a leg support member and ring support member that each fit within and couple to the grooves in the first and second ends of the fan body. When positioned within in the grooves, each leg support member and ring member may mate with one another. The at least two supports may both be removably coupled to the fan body or one of the at least two supports may be permanently coupled to the first end of the fan body. The fan may further include a fan body having a double crossflow fan blower centered in the body of the fan with a motor positioned between the fan blowers in the center of the fan body.

Other devices, apparatus, systems, methods, features and advantages of the invention are or will become apparent to one with skill in the art upon examination of the following figures and detailed description. It is intended that all such additional systems, methods, features and advantages be included within this description, be within the scope of the invention, and be protected by the accompanying claims.

DESCRIPTION OF FIGURES

The invention may be better understood by referring to the following figures. The components in the figures are not necessarily to scale, emphasis instead being placed upon illustrating the principles of the invention.

DETAILED DESCRIPTION OF THE INVENTION

Figure 1:
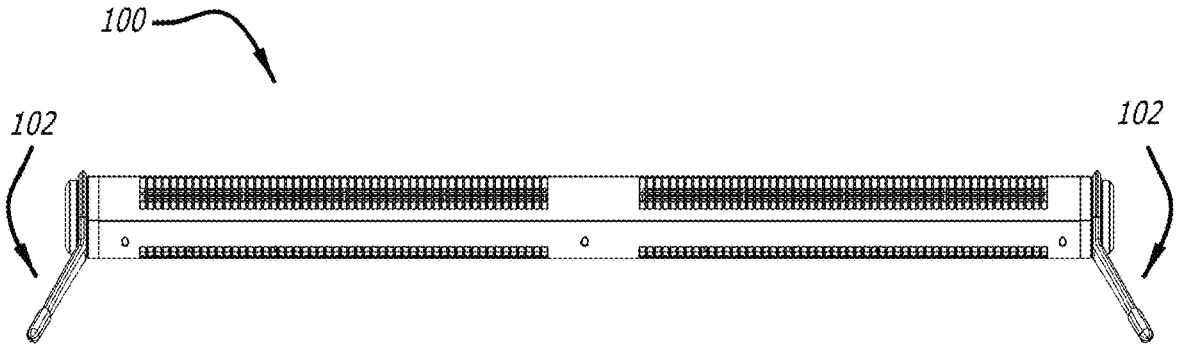
FIG. 1 is a front perspective view one example of an implementation of the present invention with the fan position in the horizontal direction.
Figure 2:
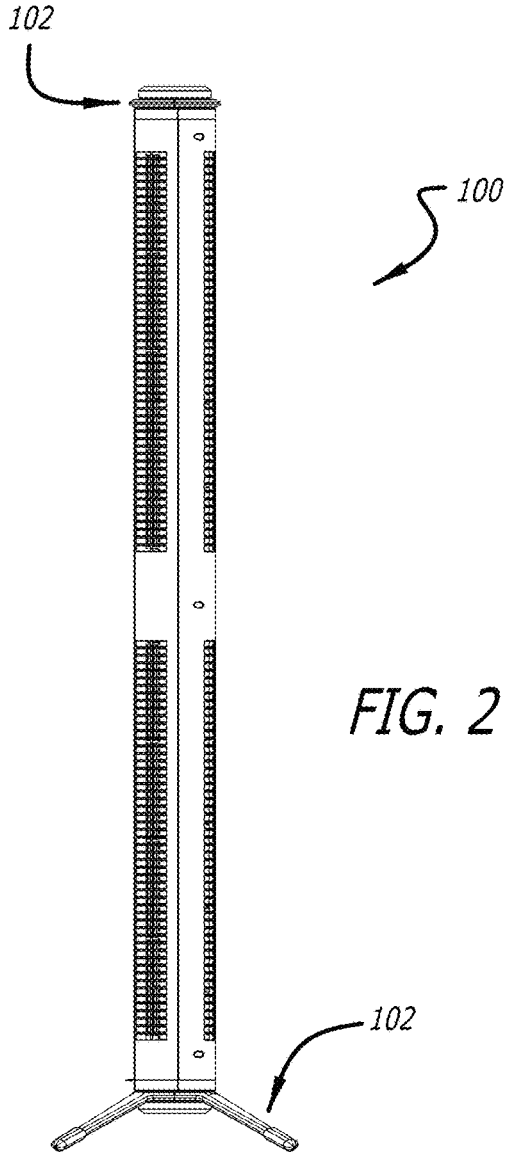
FIG. 2 is a front perspective view of the fan of FIG. 1 having the supports reconfigured to position the fan in the vertical direction.

As illustrated in FIG. 1-18, tower fan 100 is provided that can be configured either vertically or horizontally. FIG. 1 is a front perspective view one example of the present invention with the fan 100 position in the horizontal direction, while FIG. 2 is a front perspective view of the fan 100 of FIG. 1 in the vertical direction. While the fan 100 of the present invention can be sold with fixed supports to maintain the fan in either the vertical or horizontal position, several examples below are provided with reconfigurable supports 102 that allow the same fan 100 to be used either in the vertical or horizontal position.

Figure 3:
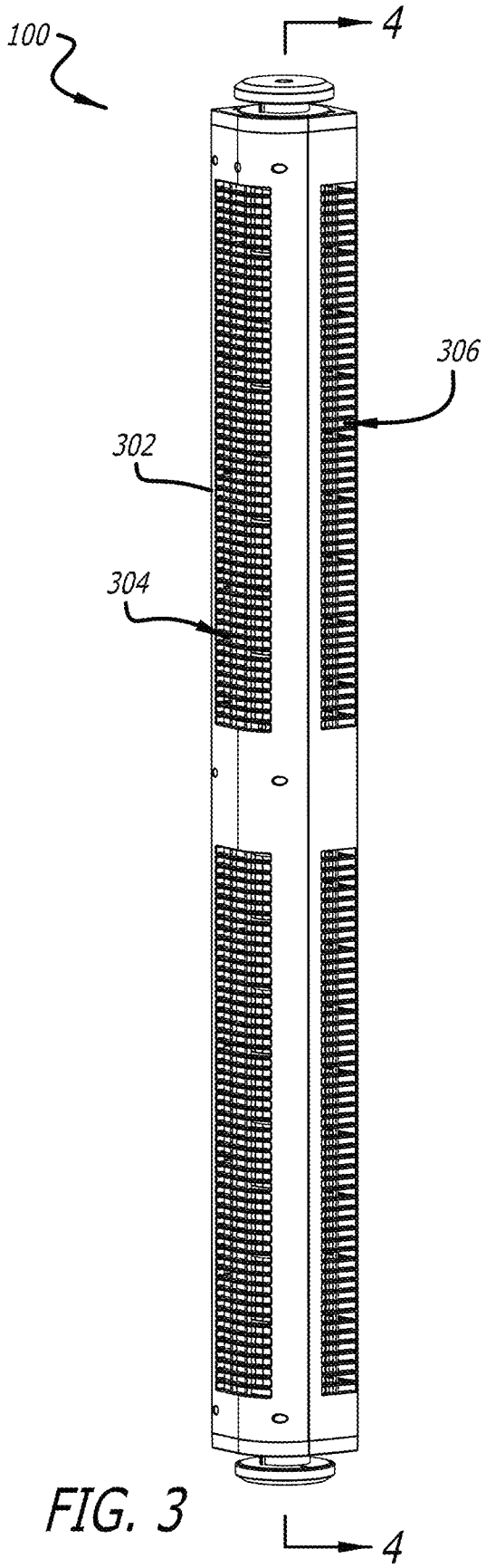
FIG. 3 is a front perspective view of the fan of FIG. 2 having these supports removed.

FIG. 3 is a front perspective view of the fan 100 of FIG. 2 having the supports 102 removed. In this example, the fan 100 is illustrated in the vertical position, as a tower fan. As illustrate in FIG. 3, the fan 100 includes a fan body 302 having a first set of opening 304 to draw air in one side of the fan body 302 and a second set of openings 306 to blow air out of the other side or front of the fan body 302.

Figure 4:
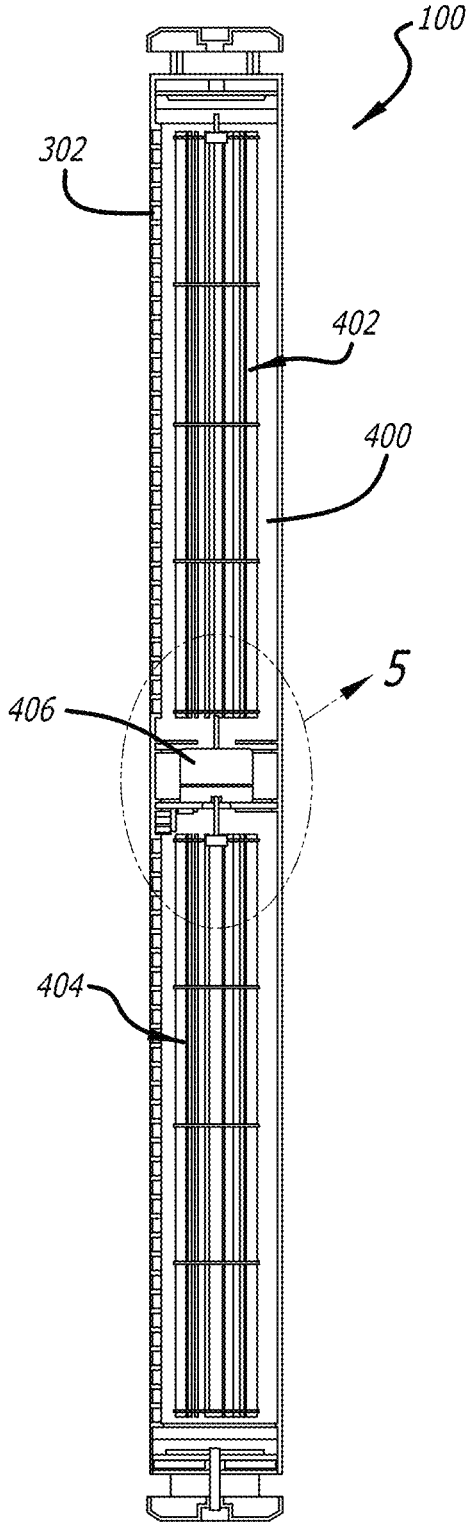
FIG. 4 is a cross-section view of the fan of FIG. 3 taken along lines 4-4.

FIG. 4 is a cross-section view of the fan 100 of FIG. 3 taken along lines 4-4. Housed within the fan body 302 is blower housing 400, which includes a first a second crossflow blower 402 and 404 with a motor 406 mounted in the middle of the fan blower housing 400 within the fan body 302. As illustrated in FIG. 3, the first set of openings 304 and second set of openings 306 are duplicated on each side of the center of the fan body 302 (i.e., on each side of the motor 406) in alignment with each crossflow blower 402 and 404.

Figure 5:
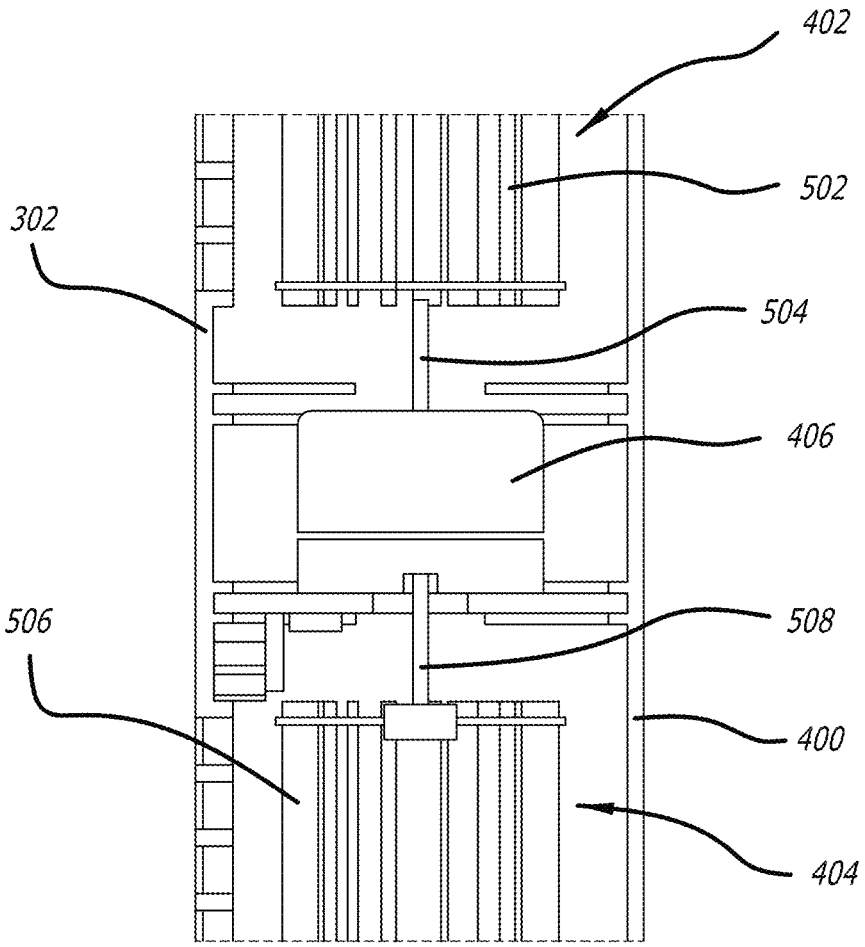
FIG. 5 is an enlarged view of the center of the fan of FIG. 4 as shown in the encircled area A.

FIG. 5 is an enlarged view of the center of the fan 100 of FIG. 4 as shown in the encircled area A. As illustrated, the motor 406 mounted in the middle of the fan blower housing 400 is a double shafted motor 406 that turns the impellers 502 of the first crossflow blower 402 above the motor 406 with a first shaft 504 and the impellers 506 of the second crossflow blower 404 below the motor 406 with a second shaft 508. As illustrated in both FIGS. 4 and 5, the motor is centered along the length of the fan body 302. By using at least two first crossflow blowers 402 and 404 with a double shafted motor 406 positioned between, the fan 100 will be more stable and will not produce as much unwanted vibration and noise as a single long blower with the motor positioned at the bottom, under the blower.

Having the motor 406 in the center of the blower housing 400 also causes the center of gravity for the fan 100 to remain unchanged whether the fan 100 is in the vertical or horizontal position. This allows for the fan 100 of the present invention to be able to be used either the vertical or horizontal position. While not shown, the fan 100 is supplied with power cither from internal or external sources and includes an integrated circuit and/or controller responsive to user controls to operate the motor 406 at various selected speeds. The fan 100 may also operate as a smart device and may be network connected, controlled remotely through Bluetooth connections and/or controlled through other signal communication from other interactive devices designed to control smart devices, such as Alexa®.

Various supports and/or mounting devices may be used to allow for the fan 100 to be easily positioned in both the vertical and/or horizontal positions. This may be accomplished with various mounting devices, such as a center pivot to allow tilt rotation, or by other base configuration(s) built-in to the body or with external attachment bases that allow for vertical or horizontal positioning. A few examples of such supports/mount devices are illustrated in FIGS. 6-18, which show modular support options for the fan 100. FIGS. 6-13 show modular reconfigurable supports 102 that attached to the fan body 400 using magnetics, whereas FIG. 14-18 show modular supports that use a friction fit to reconfigure the supports 102. Those skilled in the art will recognize that the taught methods of attachment in the illustrated examples could be interchanged. Further, other alternative methods for coupling the supports 102 to the fan body 302 may be used without departing from the scope of the invention.

Figure 6:
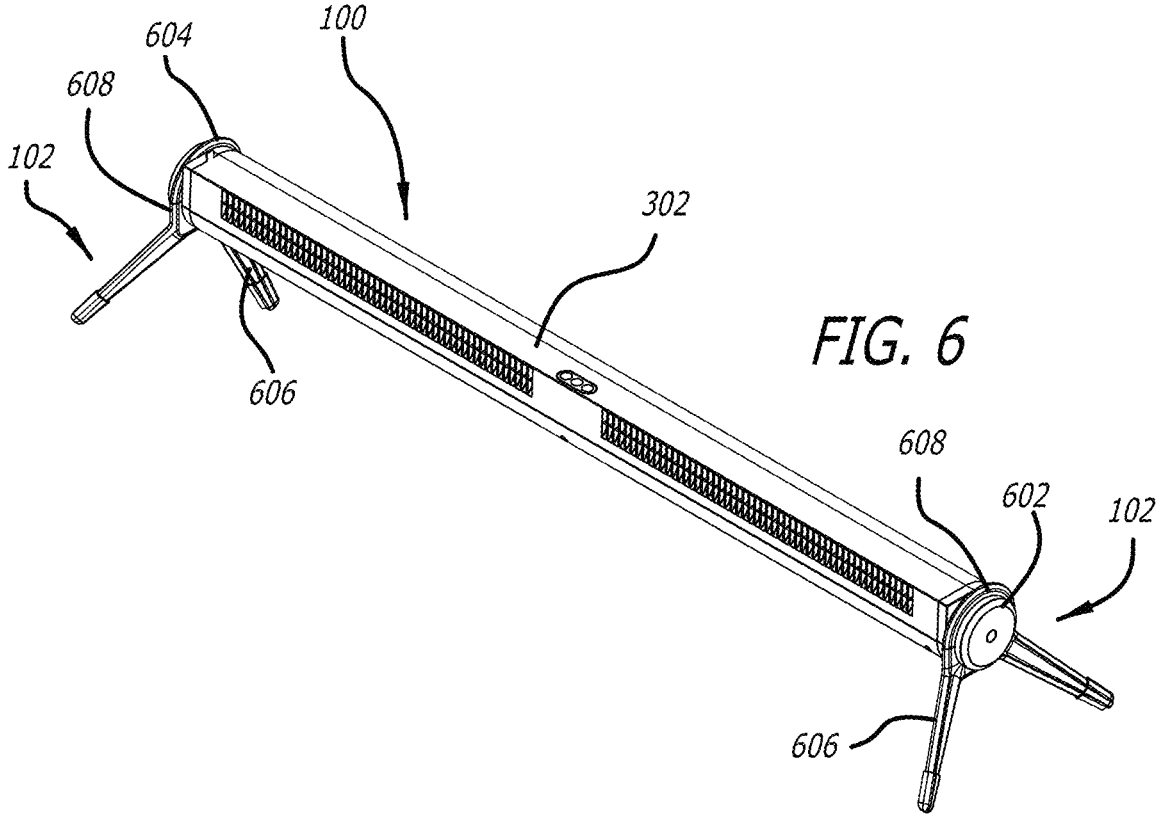
FIG. 6 is a front side perspective view of one example of an implementation of the fan of the present invention position in the horizontal direction.

FIG. 6 is a front side perspective view of one example of an implementation of the fan 100 of the present invention position in the horizontal direction with supports 102. As illustrated, the fan 100 includes a fan body 302 having a first end 602 and second end 604. In this example, a pair of supports 102 are provided, with one support 102 positioned at each of the first end 602 and second end 604 of the fan body 302. Each support 102 includes a leg support member 606 and a ring member 608.

Figure 7:
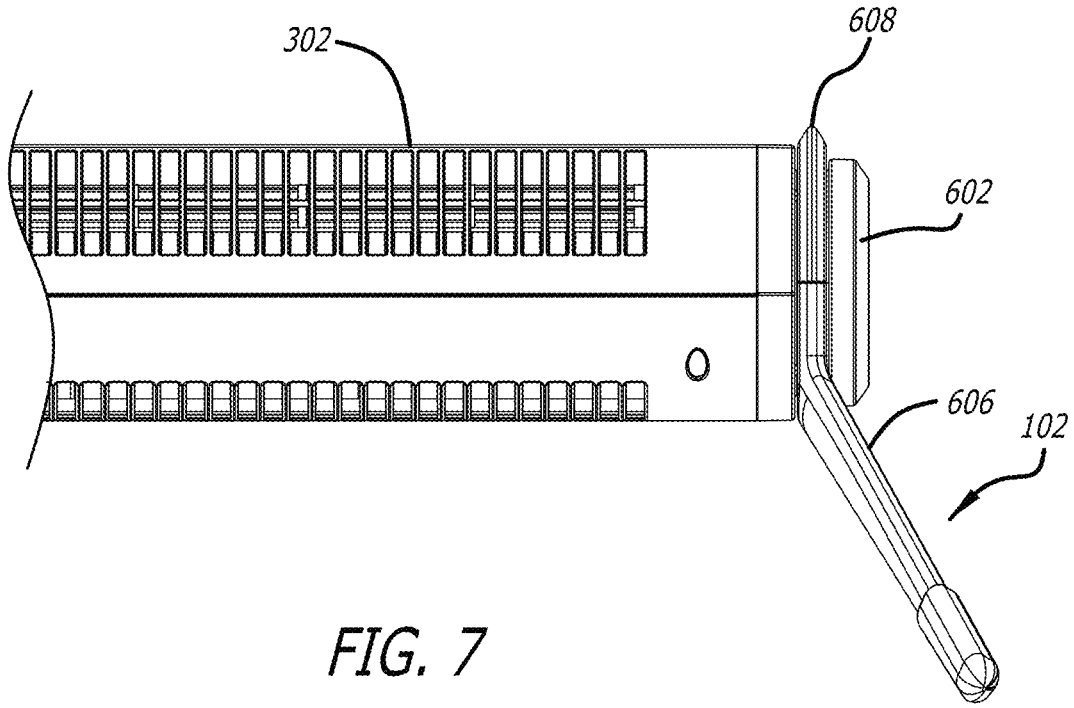
FIG. 7 is a front view of the first end of the fan of FIG. 6 illustrating one set of supports positioned on the first end of the fan body.

FIG. 7 is a front view of the first end 602 of the fan 100 of FIG. 6 illustrating one set of supports 102 positioned on the first end 602 of the fan body 302. Each of the supports 102 includes a leg support member 606 and a finishing ring member 608. As will be described further below, the legs support members 606 and finishing ring members 608 are removable and can be positioned on either the first end 602 or second end 604 of the fan body 302 to support the fan in either a vertical or horizontal configuration.

Figure 8:
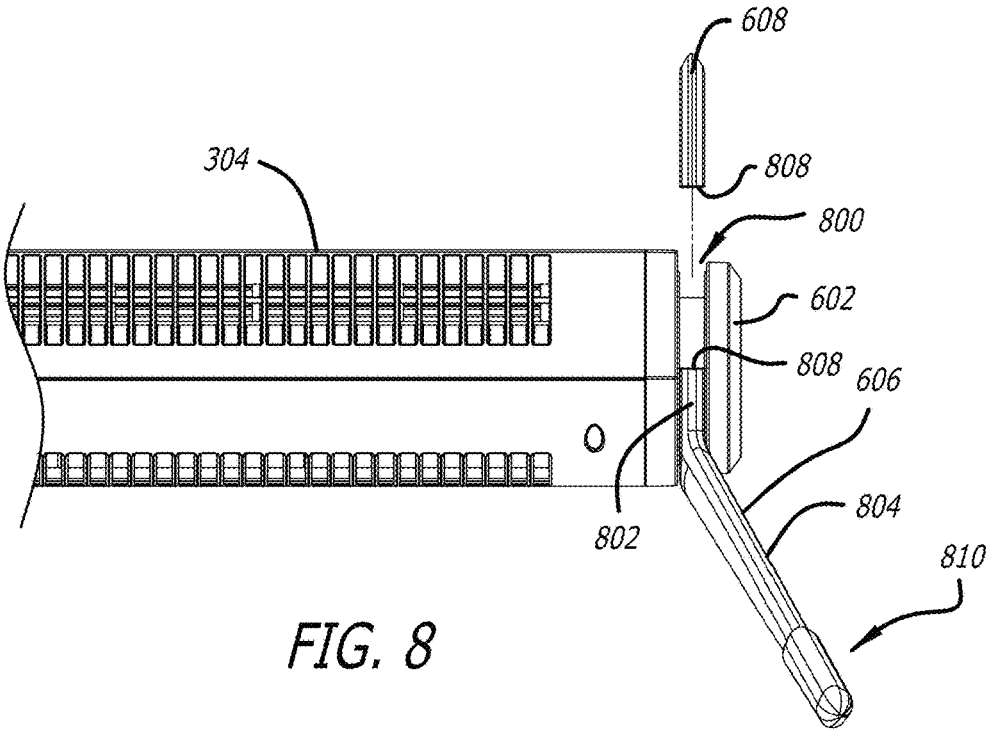
FIG. 8 is a front view of one end of the fan of FIG. 6 illustrating the ring support member removed from the end of the fan.

Turning to FIG. 8, FIG. 8 is a front view of the first end 602 of the fan 100 of FIG. 6. As illustrated in FIG. 6, a circular groove 800 is located at the first end 602 of the fan body 302. A corresponding circular groove 1200 (FIG. 12) is similarly positioned on the second end of the fan body 302. Each leg support member 606 includes a circular section 802 that can slip into or couple with the circular grooves 800, 1200 located at the first and second ends 602, 604 of the fan body 302. The leg support members 606 furthers include at least one support contact 804, which in this example includes at least two support contacts 804 for supporting the fan 100 on a support surface 810. The leg support members 606 and finish ring members 608 can be made of cast metal, plastic, a wire form or other alternate material or form.

To couple the leg support members 606 and finishing ring members 608 within the circular grooves 800, 1200 located at the first and second ends 602, 604 of the fan body 302, the leg support members 606 and finishing ring members 608 may include magnets to retain them in position. For example, the mating ends of the leg supports members 606 and finishing ring member 608 may include magnets 808 such that the oppose leg support member 606 and finishing ring member 608 magnetically attached, due to opposite polarity attraction. Here, the leg support members 608 and the finishing ring members 608 in each pair would each need to have opposite polarities so that when leg supports members 606 are rearranged to permit the fan 100 to be oriented in a vertical directions both leg support members 606 and both finishing ring member 608 would attract one another, yet still allow each leg support member 606 to attract at least one of the ring support members 608 when oriented horizontally.

Alternatively, the circular grooves 800, 1200 may include magnetics for attracting magnets embedded in the leg supports members 606 and finishing ring member 608. Here, the magnets in the circular grooves 800, 1200 may both have the same polarity and all the members of the supports 102 may have the opposite polarity.

FIG. 8-13 illustrate how the supports 102 are reconfigurable to change the orientation of the fan from a vertical position to a horizontal position or from a horizontal positioned to a vertical position. For example, in the horizontal orientation, the supports 102 each include one leg support member 606 and one finishing ring member 608 attached or coupled to the first and second ends 602, 604 of the fan body 302. The leg support members 606 are both attached to the bottom, with the ring support members 608 attached to the top (as illustrated in FIG. 6). This positions the support contact(s) 804 in the same direction, to support the fan 100 on a support surface 810 a horizontal orientation, providing legs on each end to provide for a stable horizontal base. Since the leg supports 102 are attached to circular grooves 800, 1200, the position in which they are attached within the circular grooves 800, 1200 can be moved to allow for the fan body 302 to be rotated up or down relative to a horizontal air flow direction, to allow for a user to better direct of the air flow toward a desired location.

In the vertical orientation, two leg support members 606 are attached magnetically on one end 602 or 604 of the fan body 604 to create a stable base assembly for supporting the fan in a vertical orientation. The finishing ring members 608 are then magnetically attached in an opposing manner in the circular groove 800, 1200 on the opposite end 602 or 604 to create a decorative element and to stow the finishing ring member 608.

Figure 9:
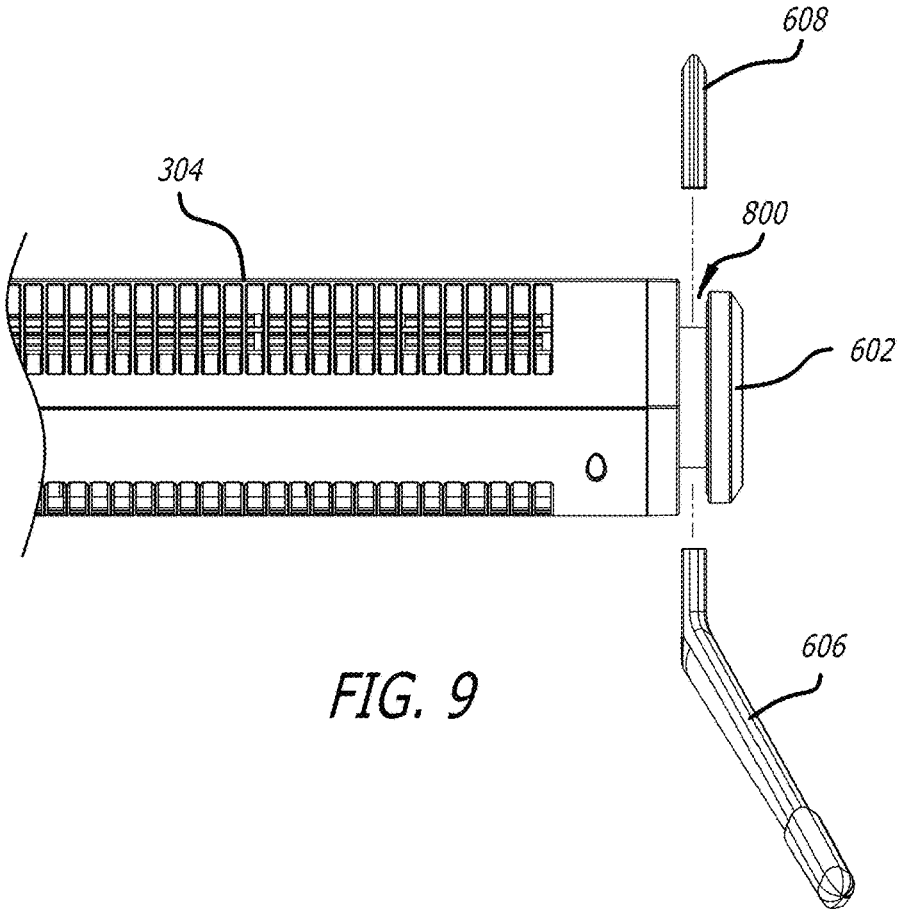
FIG. 9 is a front view of one end of the fan of FIG. 6 illustrating both the ring support and leg support members removed from the end of the fan.

In FIG. 8, one finishing ring member 608 is shown being removed from the first end 602 of the fan body 302 exposing the circular groove 800 on the first end 602 on the fan body 302. FIG. 9 is a front view of the first end 602 of the fan body 304 illustrating both the ring support member 608 and leg support members 606 removed from the first end 602 of the fan body 302 of the fan 100. This illustrates the circular groove 800 and the removability of both the ring support member 608 and leg support members 606 for reconfiguration.

Figure 10:
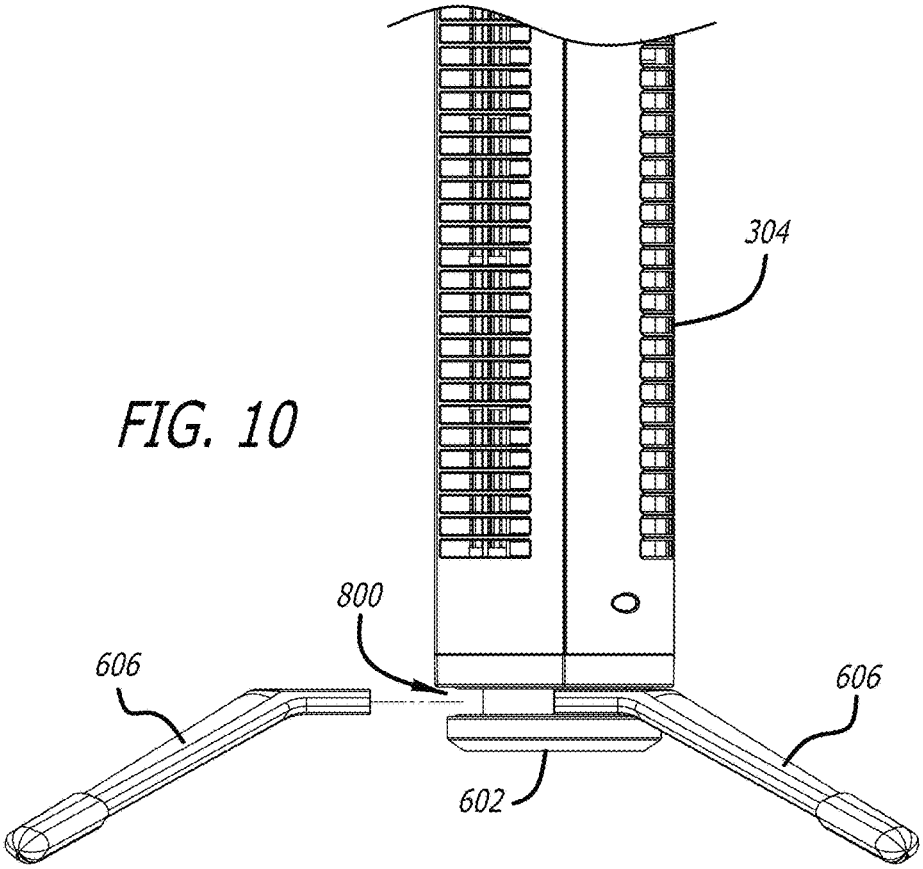
FIG. 10 is a front view of one end of the fan of FIG. 6 illustrating a second leg support being paired with a first leg support to provide supports for orienting the fan vertically.
Figure 11:
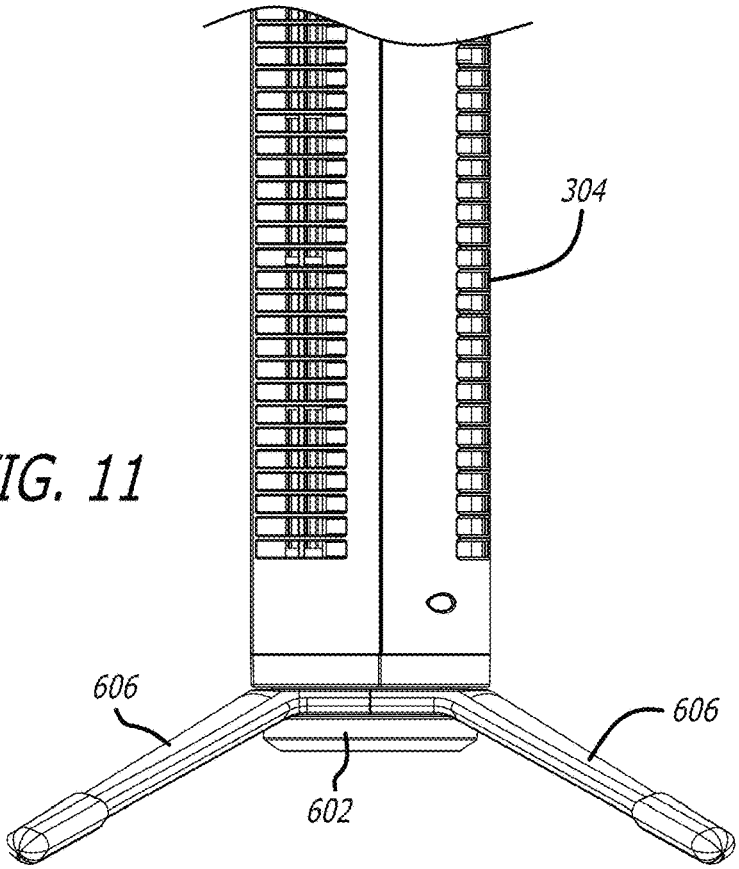
FIG. 11 is a front view of the opposition top end of the fan of FIG. 10 illustrating the first and second leg supports positioned together on one end of the fan to support the fan in a vertical position, as a tower fan.

FIG. 10 is a front view of one first end 602 of the fan of FIG. 6 illustrating both leg support members 608 being paired together in an opposing manner in the circular groove 800 to provide support for orienting the fan vertically. FIG. 11 shows the leg support members 608 positioned together, in opposing member, in the circular groove 800 on the first end 602 of the fan body 302 of the fan 100 to support the fan 100 in a vertical position, as a tower fan.

Figure 12:
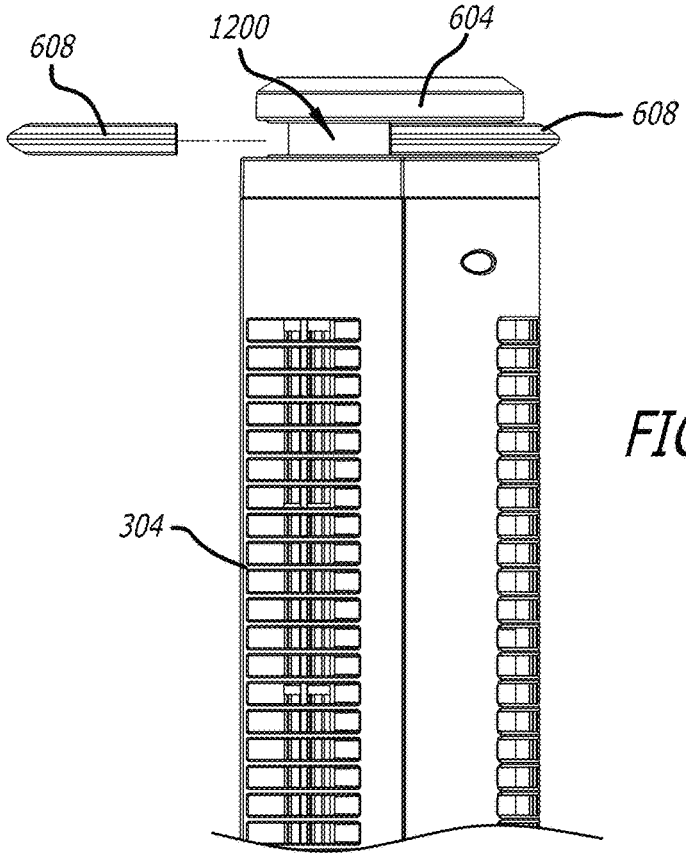
FIG. 12 is a front view of the opposing end of the fan of FIG. 10 illustrating a second ring being paired with a first ring support.
Figure 13:
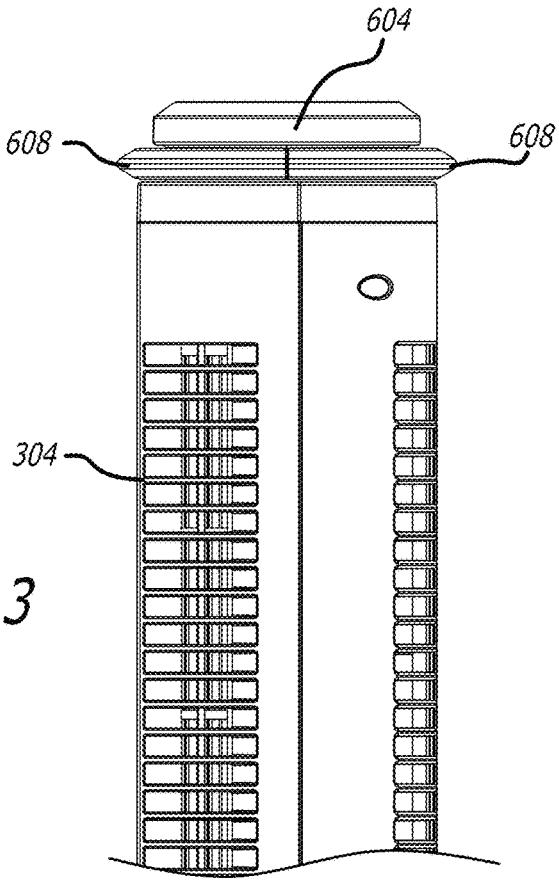
FIG. 13 is a front view of the opposing end of the fan of FIG. 10 illustrating the second ring positioned together with the first ring support to create a ring around the top of the fan when the fan is positioned in the vertical position.

FIG. 12 is a front view of the opposing second end 604 of the fan 100 illustrating both leg members being paired together in an opposing manner in the circular groove 1200 to create a decorative element and to stow the finishing ring member 608. FIG. 13 shows the two finishing rings is a front view of the opposing end of the fan of FIG. 10 illustrating the second ring positioned together positioned together, in opposing member, in the circular groove 1200 on the second end 604 of the fan body 302 of the fan 100, creating the decorative element on the top of the fan when positioned in the vertical orientation.

While the present example shows all the leg support members 606 and finishing ring members 608 to be removable and reconfigurable, those skilled in the art will recognize that only one of each of the leg support members 606 and finishing ring members 608 are required to be removable to reconfigure the orientation of the fan 100 from a vertical to horizontal orientation.

FIG. 14-FIG. 18 illustrate another alternative implementation of the support members 606 to reconfigure a fan 1400 from a horizontal to vertical position. Here, the fan body 1404 only includes a single crossflow fan, recognizing that the use of the reconfigurable supports 102 are not limited to a double crossflow fan 100. However, the supports members 606 of fan 1400 may also be used in connection with a double crossflow fan 100.

Figure 14:
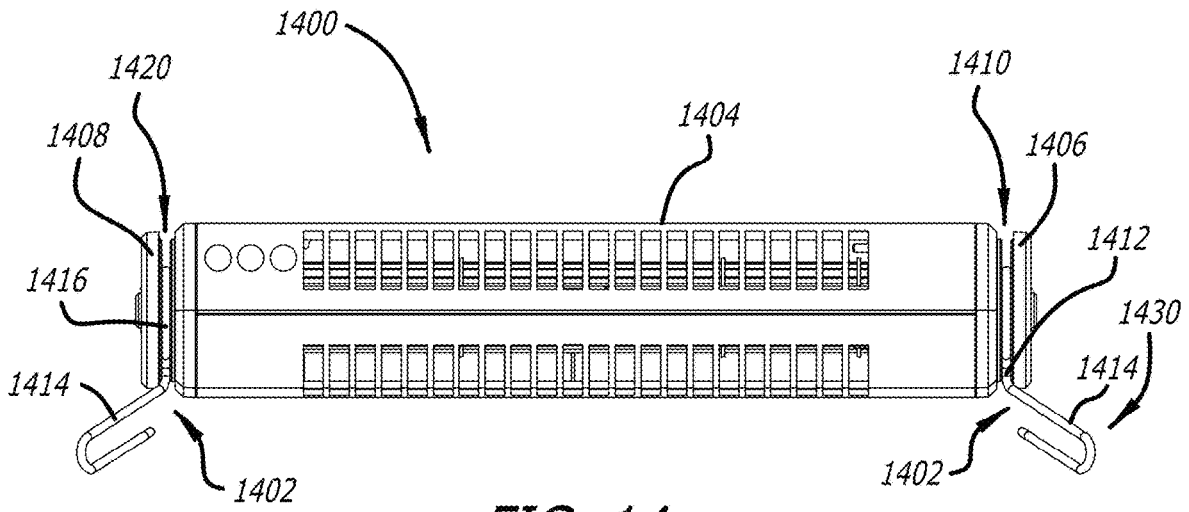
FIG. 14 is a front side perspective view of another example of an implementation of the fan of the present invention position in the horizontal direction.

FIG. 14 is a front side perspective view of another example of a fan 1400 of the present invention position in the horizontal direction. Here, the supports 1402 are wire form supports and are attached to circular grooves 1410 and 1420 using a friction fit, or alternatively, where one is permanently attached, and the other is removable via a friction fit. Magnetics, adhesives or other mechanisms for removable attachment may also be used in this example design without departing from the scope of the invention.

Like the prior example, the fan 1400 includes a fan body 1404 having first and second ends 1406, 1408, which one support 1402 positioned on each end when the fan 1400 is positioned horizontally, and with both supports 1402 positioned together, in an opposing manner, on either the first or second end 1406, 1408 when positioned vertically.

Figure 15:
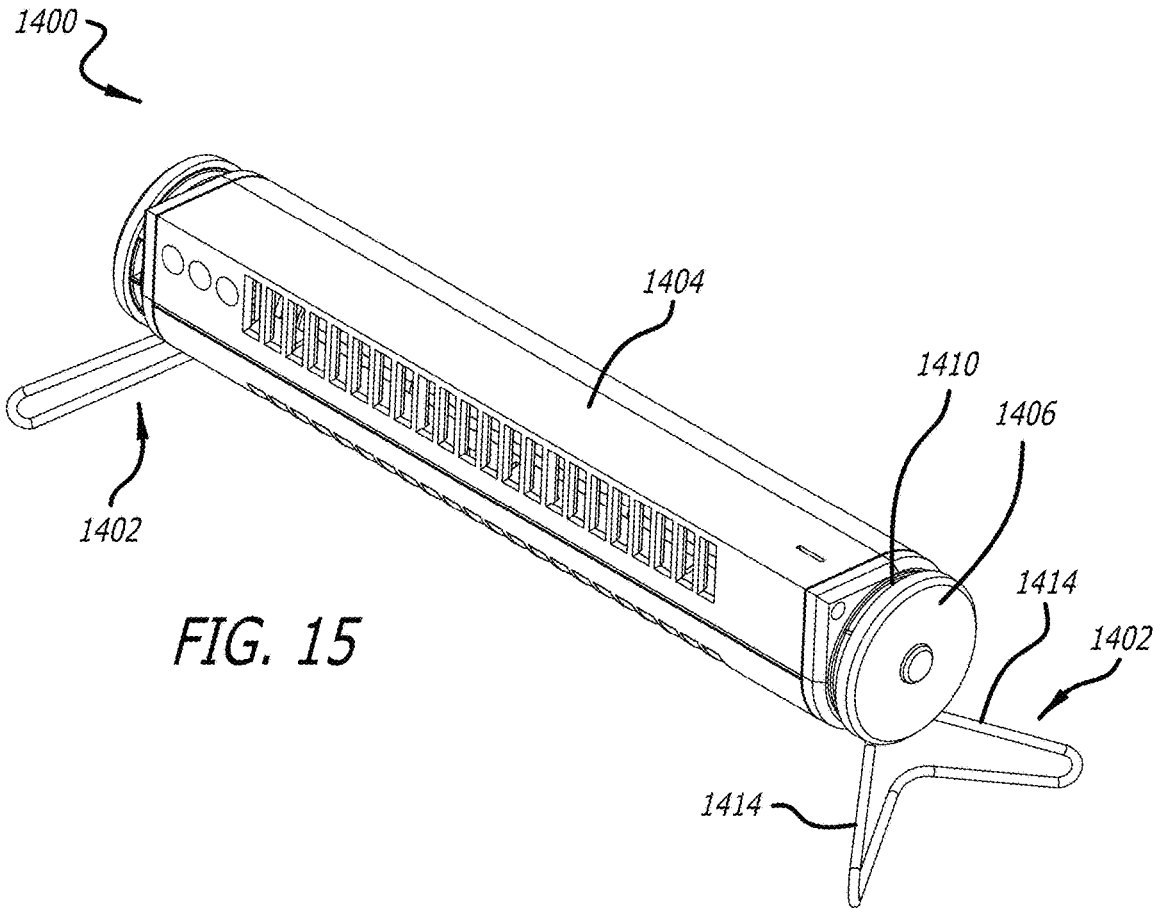
FIG. 15 is a front side perspective view of one end of the fan of FIG. 14 illustrating a first orientation for the fan of FIG. 14.
Figure 16:
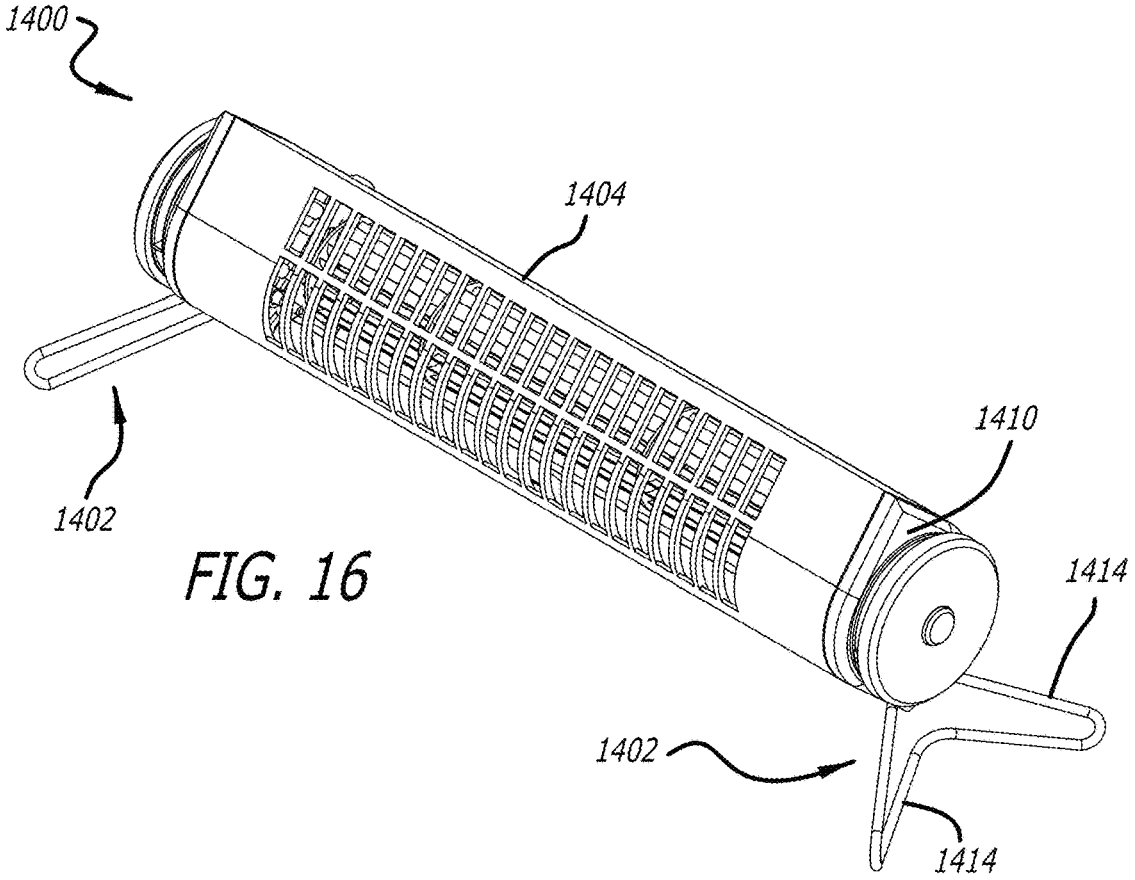
FIG. 16 is a front side perspective view of one end of the fan of FIG. 14 illustrate a second orientation for the fan of FIG. 14.

Again, with the supports 1402 being reconfigurable, the direction of the air flow of the fan 1400 may be changed by the user. For example, FIG. 15 is a front view side perspective view of one end of the fan of FIG. 14 illustrating a first orientation for the fan of FIG. 14, whereas FIG. 16 illustrates a second orientation for the fan of FIG. 14. Here, each support may include a circular portion 1412 and 1416 for engaging the circular grooves 1410, 1420 and legs portions 1414 for supporting the fan 1400 on a support surface 1430. The circular portions 1412 and 1416 may be of similar or different configuration to allow the supports 1402 to both be able to engage on circular groove 1410 in opposing manner to support the fan 1400 in a vertical orientation.

Figure 17:
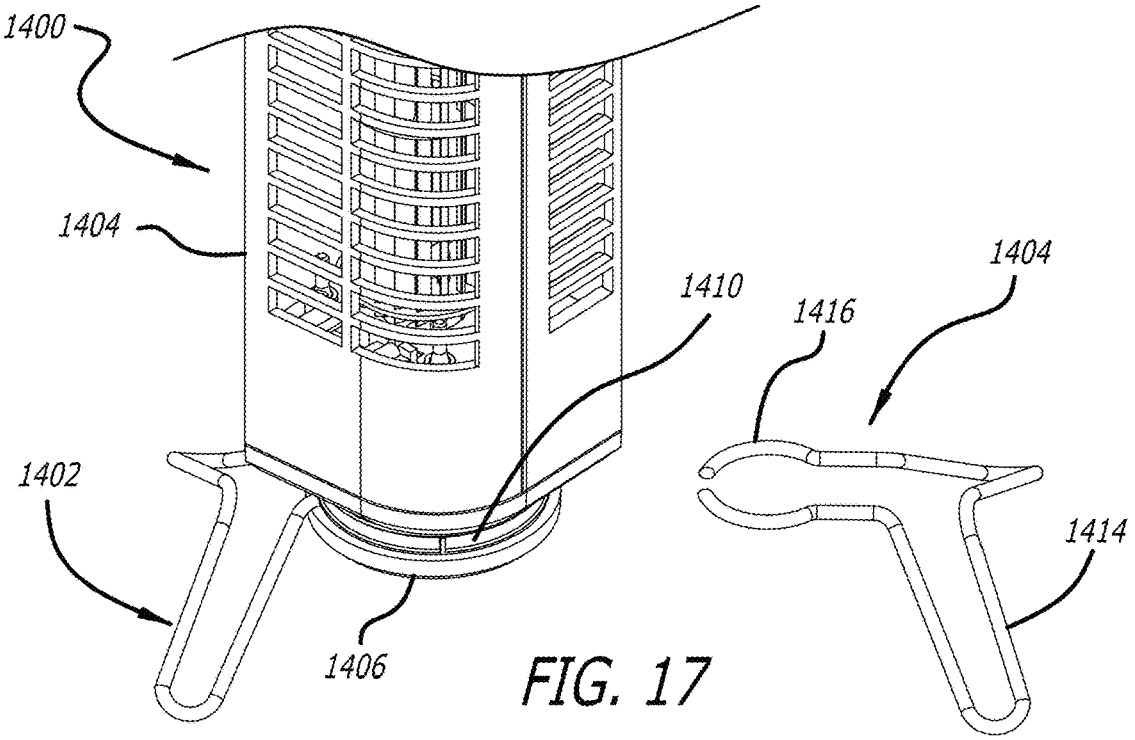
FIG. 17 is a front view of one end of the fan of FIG. 14 illustrating the second leg support removed from the second end of the fan and being paired with the first leg support on the first end of the fan.
Figure 18:
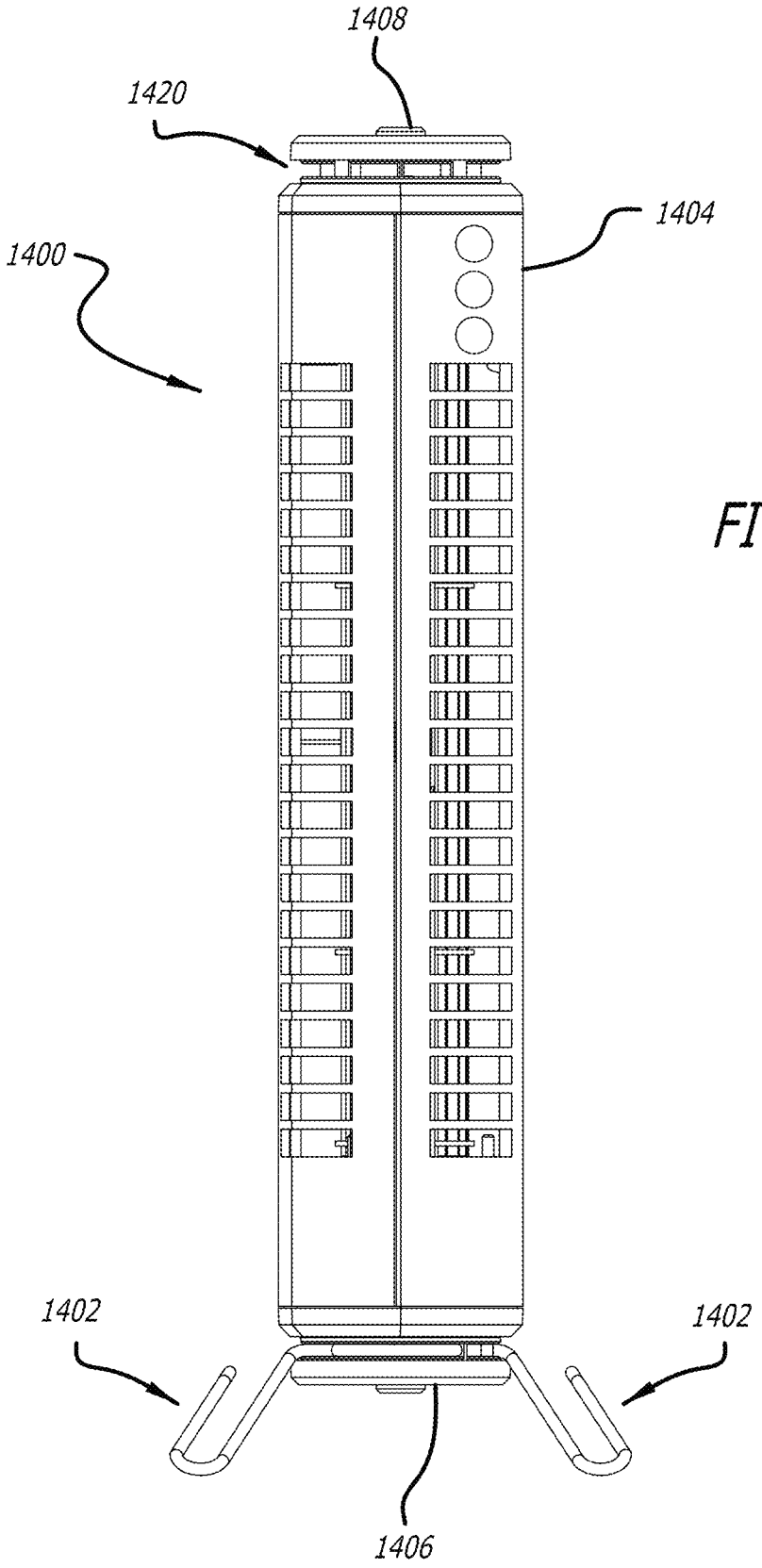
FIG. 18 is a front view of the opposing top end of the fan of FIG. 14 illustrating the first and second leg supports positioned together on the first end of the fan to support the fan in a vertical position, as a tower fan.

FIG. 17 is a front view of the first end 1406 the fan 1400 of FIG. 14 illustrating one of the leg supports 1402 removed from the second end 1408 of the fan 1400 and being paired with the leg support 1402 on the first end 1406 of the fan 1400. As shown, the leg support 1402 that has been removed and is being paired in an opposing manner with the other leg support 1402 on the first end 1406 includes a circular portion 1416 that fits within the groove 1410 to engage the groove 1410. Both leg supports 1402 include legs portions 1414 for supporting the fan 1400 on a support surface 1430. Here, the leg support 1402 shown on the left side may be permanently attached to the first end 1406 or may be removably coupled. FIG. 18 is a front view of the fan 1400 illustrating the leg supports 1402 positioned together on the first end 1406 of the fan to support the fan 1400 in a vertical position, as a tower fan.

The foregoing description of an implementation has been presented for purposes of illustration and description. It is not exhaustive and does not limit the claimed inventions to the precise form disclosed. Modifications and variations are possible in light of the above description or may be acquired from practicing the invention. The claims and their equivalents define the scope of the invention.

We claim:

1. A fan configured to be oriented in both the horizontal and vertical directions, the fan comprising:

a fan body having a central portion and first and second end, the fan body further including a first series of openings and second series of opening positioned in alignment with one another on opposing sides of the central portion of the fan body; and the fan body further including a housing having internal support members located in the central portion of the housing;

a motor mounted on the internal support members located in the central portion of the housing;

a first and second blower, each in operable communication with the motor such that the blowers are driven by the motor, where the first blower is positioned on one side the motor within the fan body and in alignment with the first series of openings to blow air out of the first series of openings when driven by the motor, and the second blower positioned on the other side of the motor within the fan body opposing the first blower and in alignment with the second series of openings to blow air out of the second series of openings when driven by the motor;

configurable supports configured to be positioned on the first and second end of the fan body to be supported in a horizontal position and also being configured to be positioned on the first end of the body to allow the fan to be supported in the vertical position.

2. The fan of claim 1 where the first end of the fan body has a groove receiving the configurable supports.

3. The fan of claim 1 where the motor drives the first and second blower simultaneously.

4. A fan configured to be oriented in both the horizontal and vertical directions, the fan comprising:

a fan body having a central portion and first and second end, the fan body further including a first series of openings and second series of opening positioned in alignment on opposing sides of the central portion of the fan body; and a motor mounted in the central portion of the fan body;

a first and second blower, each in operable communication with the motor, where the first blower is positioned on one side the motor within the fan body and aligned with the first series of opening to blow air out of the first series of openings, and the second blower is positioned on the side of the motor within the fan body opposing the first blower and in alignment with the second series of openings to blow air out of the second series of openings;

a set of supports positioned on the first and second end of the fan body to allow the fan body to be supported in a horizontal position; and at least one support positioned on the first end of the fan body to allow the fan body to be supported in the vertical position.

5. The fan of claim 4 where the at least one support positioned on the first end of the fan body also functions as one of the sets of the supports that allows the fan body to be supported in a horizontal position.

6. The fan of claim 4 where the motor drives the first and second blower simultaneously.

7. A tower fan oriented in a vertical direction, the fan comprising:

a fan body having a central portion and first and second end, the fan body further including a first series of openings and second series of openings positioned in alignment on opposing sides of the central portion of the fan body; and a motor mounted in the central portion of the fan body;

a first and second blower, each in operable communication with the motor, where the first blower is positioned on one side the motor within the fan body and aligned with the first series of opening to blow air out of the first series of openings, and the second blower positioned on the side the motor within the fan body opposing the first blower and in alignment with the second series of openings to blow air out of the second series of openings; and supports extending from the first end of the fan body to be supported in a vertical position.

8. The tower fan of claim 7, where the supports extending from the first end of the blower are configurable supports configured to be positioned both the first and second end of the blower to allow the fan body to be supported in a horizontal position as well as a vertical position.

9. The tower fan of claim 7, where the fan body further includes a housing having internal support members located in the central portion of the housing for supporting the motor.

10. The tower fan of claim 7, where the first and second blowers extend from the motor to the first and second ends of the fan body.

* * * * *